United States Patent [19]

Goeglein

[11] 4,082,388

[45] Apr. 4, 1978

[54] COLLAPSIBLE DISPLAY BOOTH

[76] Inventor: Roy F. Goeglein, 3102 E. Maple Grove Ave., Fort Wayne, Ind. 46806

[21] Appl. No.: 742,692

[22] Filed: Nov. 17, 1976

[51] Int. Cl.[2] ..... A47B 43/00

[52] U.S. Cl. ..... 312/258; 312/257 R; 312/297

[58] Field of Search ..... 312/257, 262, 258, 289, 312/100, 231, 297; 52/32; 211/135

[56] References Cited

U.S. PATENT DOCUMENTS

| | | | |
|---|---|---|---|
| 282,794 | 8/1883 | Starling | 312/100 |
| 941,013 | 11/1909 | Duble et al. | 312/258 |
| 1,262,209 | 4/1918 | King | 312/262 |
| 1,889,760 | 12/1932 | Peters | 312/258 |
| 2,631,915 | 3/1953 | Wintersteen | 312/262 |
| 2,680,932 | 6/1954 | Rona | 312/231 |
| 3,363,390 | 1/1968 | Crane et al. | 52/716 |
| 3,378,322 | 4/1968 | Johnson | 312/231 |
| 3,559,814 | 2/1971 | Downing | 211/135 |
| 3,764,059 | 10/1973 | Knowles | 312/258 |
| 4,021,089 | 5/1977 | Bush | 312/257 R |

FOREIGN PATENT DOCUMENTS

| | | | |
|---|---|---|---|
| 1,199,943 | 11/1958 | Germany | 312/258 |
| 261,318 | 5/1949 | Switzerland | 312/258 |

*Primary Examiner*—Paul R. Gilliam
*Assistant Examiner*—Victor N. Sakran
*Attorney, Agent, or Firm*—Gust, Irish, Jeffers & Rickert

[57] ABSTRACT

A plurality of transversely alignable elongate wall sections having longitudinal edges of adjacent sections in abutting relation. Hinges are connected between each of the abutting longitudinal edges so that the wall sections are foldable to form an enclosure. Each of the wall sections have upper and lower transverse edges with the upper edges being in horizontal alignment and the lower edges being in horizontal alignment. An elongate channel having a U-shaped cross-section is removably fitted over the upper transverse edges and a similar channel is fitted over the lower edges to secure the wall sections in planar alignment. A pair of elongate stabilizers are removably fitted to the lower channel and extend substantially orthogonally from either side of the wall section. A planar elongate cabinet top is removably and orthogonally supported to a lower portion of the wall sections and an elongate planar cabinet front is removably positioned between the cabinet top and the stabilizers to form a cabinet enclosure. The channels are longitudinally adjustable to provide for additional wall sections and each of the wall sections slidably receives decorative panels. Supporting arms are hingedly mounted to the rear surface of the wall sections and are removably attachable to the stabilizers for wall section support. The entire display booth can be disassembled and the wall sections can be folded and secured to form an enclosure for the disassembled parts thus forming a self-contained shipping crate.

13 Claims, 19 Drawing Figures

COLLAPSIBLE DISPLAY BOOTH

BACKGROUND OF THE INVENTION

1. Field of the Invention

This invention is in the field of display booths which may be readily disassembled and reassembled, with the display booth components forming a crating enclosure for booth shipment.

2. Description of the Prior Art

Collapsible display booths are known to the art. The desirability for such booths becomes apparent for exhibitors who have display requirements which are temporary in nature and require movement between display locations. The costs of erecting display structures from raw materials and disposing of such structures after a relatively brief display period are prohibitive. Yet, due to the unavailability of an adequate collapsible and transportable display unit, common practice in the industry today is to suffer such expenses.

SUMMARY OF THE INVENTION

A display booth is comprised of a plurality of transversely alignable elongate wall sections each of which has longitudinal edges which are in abutting relation to the longitudinal edges of adjacent sections. A longitudinal hinge connects each of the abutting longitudinal edges so that the wall sections can be folded into a crate configuration to define a shipping enclosure. The wall sections have upper transverse edges in horizontal alignment and lower transverse edges in horizontal alignment. A U-shaped cross-section channel is removably fitted over the upper edges and a similar channel is fitted over the lower edges to provide support in the assembled booth configuration. The channels are longitudinally adjustable to provide support for additional wall sections to increase booth size. A pair of elongate stabilizers are removably attachable to the lower channels at transversely spaced points and extend orthogonally on either side of the wall sections to support the wall in vertical relation to a floor surface.

A plurality of elongate supports are removably attachable to lower wall portions and extend orthogonally from the front surface of the wall sections. A planar elongate cabinet top is layable over the supports and an elongate planar cabinet front is placable between the lower surface of the cabinet top and the stabilizers to thus define a cabinet enclosure in the assembled booth. The cabinet front has doors which are hingedly mounted thereto to provide access to the cabinet enclosure.

Each of the wall sections slidably receives a decorative panel which dimensionally corresponds to its respective wall section. Elongate end channels each having a U-shaped cross-section, are attached to opposite ends of both the upper and lower elongate channels and extend obliquely therefrom. Elongate end wall sections are insertable in the first and second end channels and thus are supported in oblique relation to the hinged wall sections.

Each of the hinged wall sections have grooved strips secured to their respective upper and lower edges for receiving end covers when the wall sections are folded to their shipping crate configuration. Two of the hinged wall sections are provided with a rigid, removable, supporting frame to which is hinged an adjustable supporting arm. In the erected booth assembly, the arms are swung outwardly and removably attached to the stabilizers to further support the wall sections in vertical relation to the floor.

A lighting housing is attachable to the erected booth adjacent the upper edges of the wall sections and extends between the obliquely extending end sections and carries lighting fixtures. The housing is provided with a translucent panel which may carry desired advertising. The housing may be disassembled and nested for shipping. Adjustable shelving may be orthogonally supported from the wall sections. The entire booth assembly may be disassembled and packed into the crate enclosure formed by the hinged wall sections for shipment.

It is therefore an object of this invention to provide a sturdy, collapsible, display booth which may be readily erected and assembled for display purposes and may be quickly disassembled and configured into a shipping crate.

It is another object of this invention to provide in such a booth a cabinet enclosure with enclosure access doors.

It is a still further object of this invention to provide in a booth of the foregoing objects a wall construction which is transversely adjustable to various booth widths.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 18:
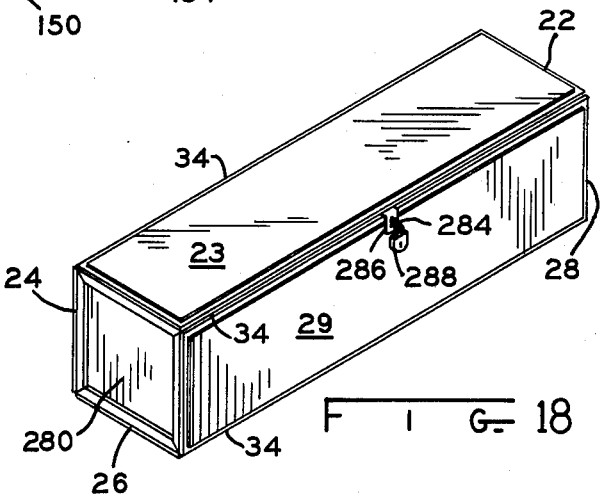
FIG. 18 is a view in perspective of the exterior of a crate formed by the wall sections of the booth of FIG. 1.
Figure 13:
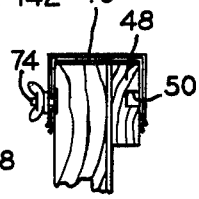
FIG. 13 is an enlarged section taken at 13—13 of FIG. 11.

Referring to the drawings, and particularly to FIGS. 1–6, a plurality of elongate wall sections 22, 24, 26 and 28 (FIG. 6), each of which is of a frame construction having parallel longitudinal members affixed at each end to and spaced by transverse members. Sections 22, 24, 26 and 28 have, respectively, exterior panels 23, 25, 27 and 29 which act as outer sides of a shipping crate, FIG. 18, later described. Each longitudinal edge of wall sections 22, 24, 26 and 28 have an elongate metal strip 30, FIG. 5, affixed thereto. Each strip 30 has an inwardly formed lip 32 at one edge thereof which is spaced from the front sides of sections 22, 24, 26 and 28 to form a front panel clearance.

Figure 5:
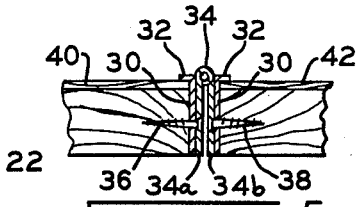
FIG. 5 is an enlarged section taken at 5—5 of FIG. 1.

Adjacent longitudinal edges of sections 22, 24, 26 and 28 have elongate "piano" hinges 34, FIG. 5, connected therebetween with the hinge plates 34*a*, 34*b* being placed over in contiguous relation to strips 30. The typical construction is shown in FIG. 5 with hinge plates 34*a* and 34*b* of hinge 34 placed over strips 30 and affixed to sections 22 and 24 by screws 36, 38, respectively.

Figure 6:
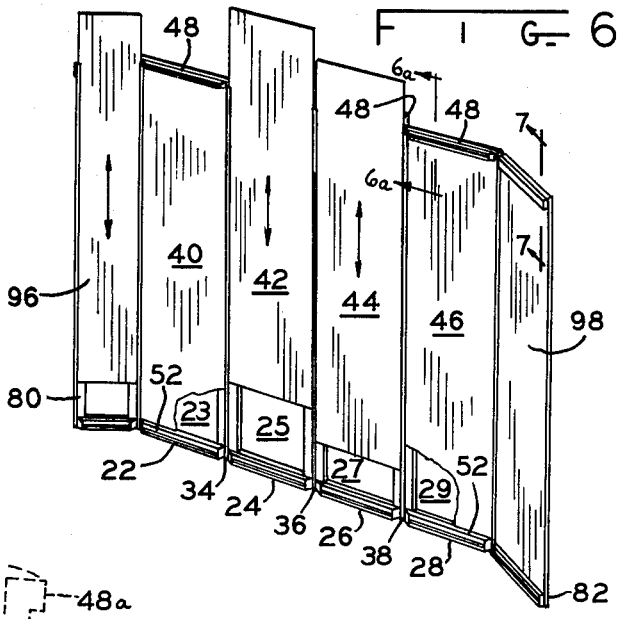
FIG. 6 is a view in perspective with several sliding decorative panels in partially installed position.
Figure 6A:
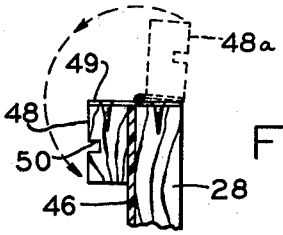
FIG. 6A is a partial section taken at 6A—6A of FIG. 6 showing strip 48 in two positions.

Decorative elongate panels 40, 42, 44 and 46 are slidably received in the panel clearances formed by lips 32 for their respective wall sections 22, 24, 26 and 28 with panels 42 and 44 shown in partially inserted position in FIG. 6. After panels 40, 42, 44 and 46 have been fully installed adjacent their respective wall sections, grooved strips 48 having elongate grooves 50 formed therein are pivoted against the top transverse edges of sections of wall sections 22, 24, 26 and 28 and similar grooved strips 52 having elongate grooves 54 are pivoted against the lower transverse edges of panels 22, 24, 26 and 28. Each strip 48 is connected by a strip hinge 49 to the upper edge of its respective wall section, and in FIG. 6A strip 48 is shown in hinged connection to wall section 28. During panel 40, 42, 44 and 46 insertion, the respective strip 48 is pivoted clockwise to position 48*a* and after insertion of the panels, strip 48 is pivoted by hinge 49 in a counter-clockwise direction against the upper transverse panel 46 after which channel 60, described next, may be placed thereover.

Referring to FIGS. 11 to 16, a first U-shaped channel section 54 has an elongate section 56 and an oblique end section 58 affixed to section 56. The angle between sections 56 and 58 is 45°. Section 56 telescopically receives an elongate section 62 of a second channel member 60 having a U-shaped cross-section, with an end channel section 64 obliquely affixed to section 62, with the angle between sections 62 and 64 being 45°. The rear wall 66, FIGS. 14–16, of section 56 has an elongate slot 68 formed intermediately and longitudinally thereof. The rear wall 70 of section 62 has an elongate slot 72 formed intermediately and longitudinally thereof and is registrable with slot 68. Wing nut fasteners 74, 76 are insertable through slots 68 and 72 and releasably hold sections 56 and 62 in adjustable longitudinal relation.

Figure 7:
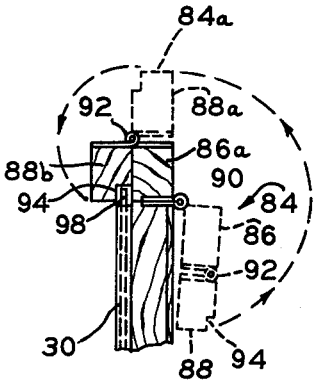
FIG. 7 is an enlarged section taken at 7—7 of FIG. 6 showing the double hinged channel support in three different hinged positions.

The width of channels 54 and 60 corresponds to the width of wall sections 22, 24, 26 and 28 and channels 54 and 60 are fittable over sections 22, 24, 26 and 28 to hold them in assembled alignment. Elongate end wall sections 80 and 82 have a frame construction similar to that for sections 22, 24, 26 and 28 and also have elongate end strips 30 affixed, as with screws, along each longitudinal edge thereof. As previously described, each strip 30 has an inwardly formed lip 32 at a longitudinal edge thereof with lip 32 forming a clearance with sections 80 and 82, respectively, to form panel clearances as with sections 22, 24, 26 and 28. Referring to FIG. 7, each end section 80 and 82 has formed at the upper transverse edges thereof a double hinged member 84. Each member 84 comprises a pair of elongate wooden strips 86, 88 with a strip 86 hingedly connected to the upper transverse edge of sections 80 and 82 by a hinge 90 and each strip 86 hingedly connected to a strip 88 by hinge 92. Strip 88 has a notch 94 formed in one corner thereof to provide transverse panel clearance, for elongate decorative panels 96 and 98 which are slidably inserted in the longitudinal panel clearances formed by lips 32 on strips 30 which are attached respectively to end sections 80 and 82. Once the panels are fully inserted, member 84 is swung about hinge 90 to position 84*a*, FIG. 7, and then strip 88 is swung from position 88*a* about hinge 92 to a position 88*b* with notch 94 receiving the top transverse edge of panel 98. The member 84 for panel 80 is likewise hingedly positioned over panel 96 and once this is accomplished, channels 54 and 60 may be fitted over the upper transverse edges of end sections 80 and 82 and wall sections 22, 24, 26 and 28 to secure booth erection.

Figure 2:
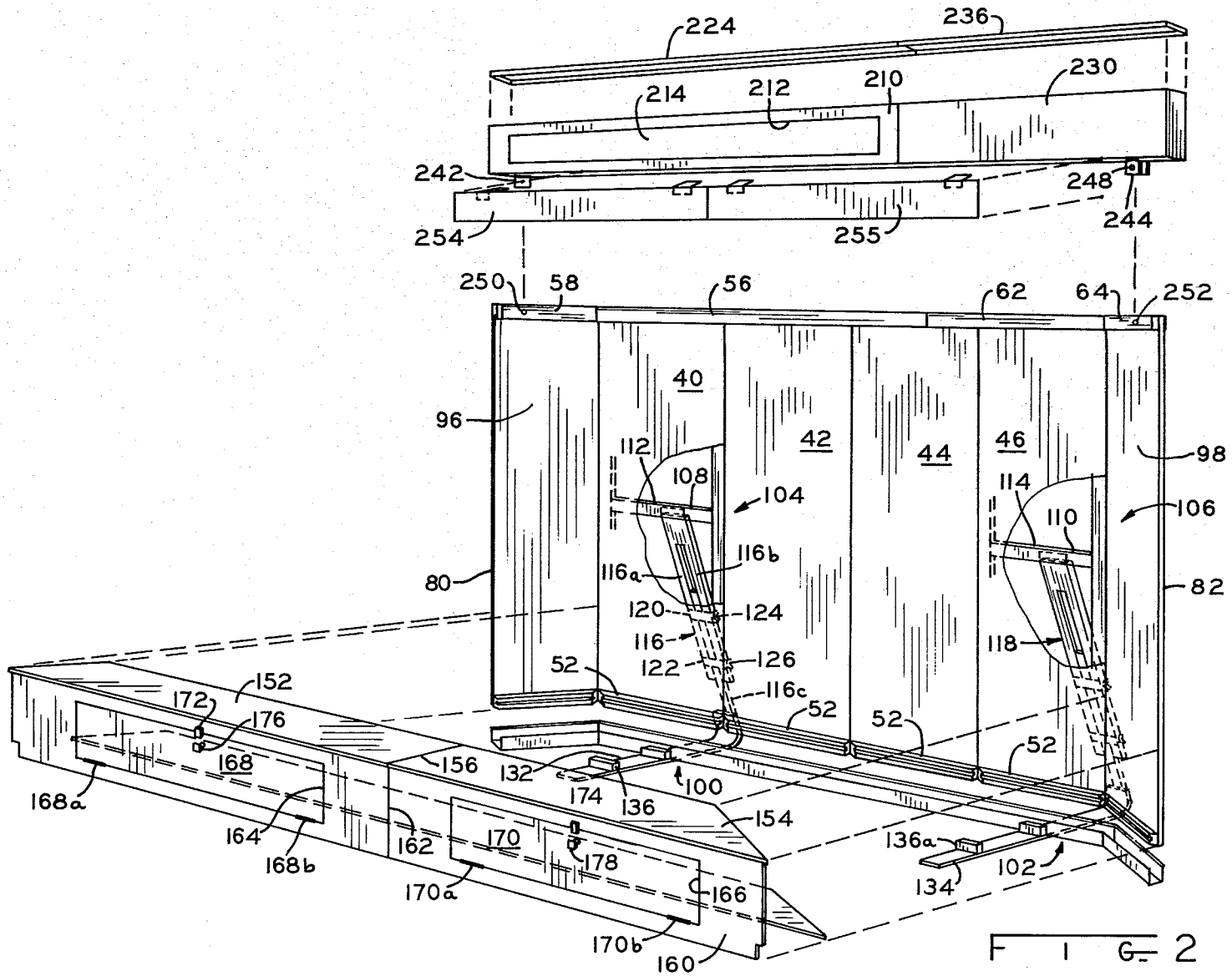
FIG. 2 is an exploded view in perspective of the above booth of FIG. 1.

Channel sections 100 and 102, FIG. 2, similarly configured and telescopically adjustable relative one another as are sections 54 and 60 have openings which face upwardly and receive the lower transverse edges of end sections 80 and 82 and sections 22, 24, 26 and 28 to further hold the booth walls in erected position. Elongate support frames 104, 106 each of which has a frame construction of elongate parallel longitudinal members and transverse end members are removably attached, as with screws, to the rear sides of sections 22 and 28 respectively. Frames 104, 106 have cross struts 108, 110, respectively, which are positioned intermediately thereof and which have hinges 112, 114 affixed respectively to the mid-points thereof. Elongate support arms 116, 118 are connected respectively at their upper ends to hinges 112, 114 and thus are hingedly connected to frames 104 and 106, respectively. Each arm 116, 118 is longitudinally adjustable and similarly constructed. Referring to arm 116, FIGS. 2 and 3, a pair of parallel, elongate transversely spaced strips 116*a* and 116*b* are held in transversely spaced relation by bands 120 and 122 each of which encircles and is affixed to each of strips 116*a* and 116*b*. A strip 116*c* is slidably mounted between strips 116*a* and 116*b*. Bands 120, 122 treadedly receive, respectively, holding bolts 124, 126 which are transversely movable through transverse openings in strip 116*b*. Bolts 124, 126 can be threadedly adjusted to bear against strip 116*c* and hold it in adjusted longitudinal position relative strips 116*a* and 116*b*. The lower end of strip 116*c* carries a removable bolt 130 so that arm 116 is removably attachable to stabilizers, next described.

Figure 3:
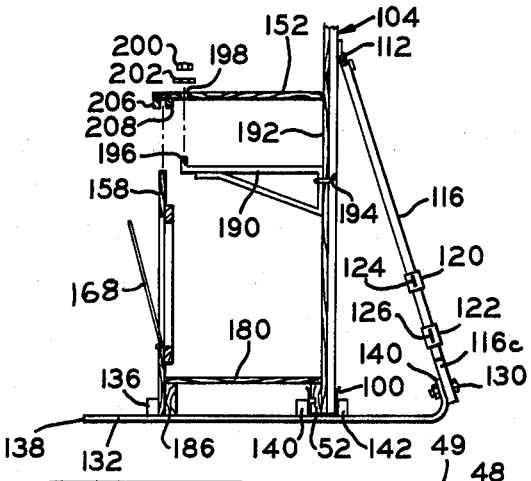
FIG. 3 is an enlarged section taken at 3—3 of FIG. 1.

Parallel elongate stabilizers 132, 134, FIGS. 2 and 3, are each orthogonally related to wall sections 22, 24, 26 and 28 and are identical in construction. Stabilizer 132 will be described, it being understood that stabilizer 134 has identical corresponding parts. Stabilizer 132 has support block 136 affixed in a predetermined spaced relation from front end 138 and has a pair of support blocks 140, 142 longitudinally spaced a distance to snugly receive channel 100 therebetween. The rearward end 144 of stabilizer 132 is formed upwardly at an acute angle and carries an opening for receiving bolt 130. Stabilizers 132, 134 may be metalic in construction and are transversely spaced to receive the lower ends, respectively, of support arms 116 and 118.

Referring to FIGS. 2 and 3 a cabinet 150 has elongate top panels 152, 154 which are hinged together by hinge 156. Elongate cabinet front panels 158, 160 are hinged together by hinge 162. Panels 158 and 160 have formed therein oblong openings 164, 166, respectively, for receiving cabinet doors 168, 170, respectively. Door 168 is hinged along its lower longitudinal edge by hinges **168*a*, 168*b* to panel 158 and door 170 is hinged along its lower longitudinal edge by hinges 170*a* and 170*b* to panel 160. Pivotable catches 172, 174 are mounted on panels 158, 160, respectively, to hold doors 168, 170, respectively, in closed position. Doors 168 and 170 are provided with knobs 176, 178, respectively for manual gripping in the conventional manner for opening and closing of the doors. Elongate cabinet floor panels 180, 182 are hinged together by hinge 184 and are supported at their forward edges by strips 186, 188 which are affixed respectively to the lower inner walls of panels 158, 160, respectively. Strips 186, 188 are the same height as strips 52, which support the rearward longitudinal edges of panels 180, 182**.

A plurality of elongate braces 190, FIG. 3, are removably attachable to respective elongate perforated strips 192, which are secured to the frame members of sections 22, 24, 26 and 28, as by angled pins 194. Each brace 190 has an upwardly formed threaded boss 196 which is registrable with openings 198 in panels 152 and 154 and each boss 196 releasably secures panels 152, 154 by threaded engagement with a nut 200. A washer 202 is placed over boss 196 prior to its threaded engagement with nut 200. Panel 152 has two elongate orthogonally spaced strips 206, 208 affixed to its forward edge which define a groove for receiving the top longitudinal edge of panel 158. Similarly, panel 154 has a pair of elongate orthogonally spaced strips, not shown, for receiving the top longitudinal edge of panel 160 when top panel 152 is laid over braces 190.

Figure 16:
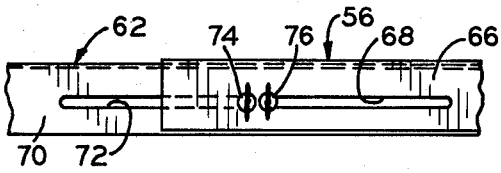
FIG. 16 is a view similar to FIG. 15 wherein the channel sections are in an extended position.

In order to add a wall section to increase booth size, winged nut fasteners 74, 76 are loosened, sections 56 and 62 are separated, FIG. 16, to provide room for insertion of a wall section 31 which is similar in construction to sections 22, 24, 26 and 28, but is not hinged to adjacent sections, and then winged fasteners 74 and 76 are tightened. The same procedure is followed for lower channel sections 100, 102. Section 31 slidably receives decorative panel 47 in the manner previously described for sections 22, 24, 26 and 28. If desired, additional wall sections may be added by appropriately increasing the length of the channel sections 54 and 100 and the slots formed therein. This has the advantage of accommodating the booth size to the available display area without sacrificing packing and portability.

Referring now to FIGS. 1 to 4 and 8 to 10, an elongate light housing 210 having a U-shaped cross-section is provided with an oblong opening 212. Translucent panel 214 is affixed to an inner wall of housing 210 to cover opening 212. Advertising messages or booth identification may be placed on panel 214.

Affixed at longitudinally spaced points to the bottom of channel housing 210 are light brackets 216 which support lighting fixtures 218, insertable through openings 220 in housing 210. Removably attached to the rear wall of housing 210 is flourescent light fixture 222 to provide lighting for panel 214. Lighting fixtures 216 and 222 are connected by means of electrical conductors, not shown, to conventional power outlets. Elongate housing cover 224 having downwardly formed edges 226, 228 is insertable over the upstanding walls of housing 210 to complete the housing enclosure.

Figure 1:
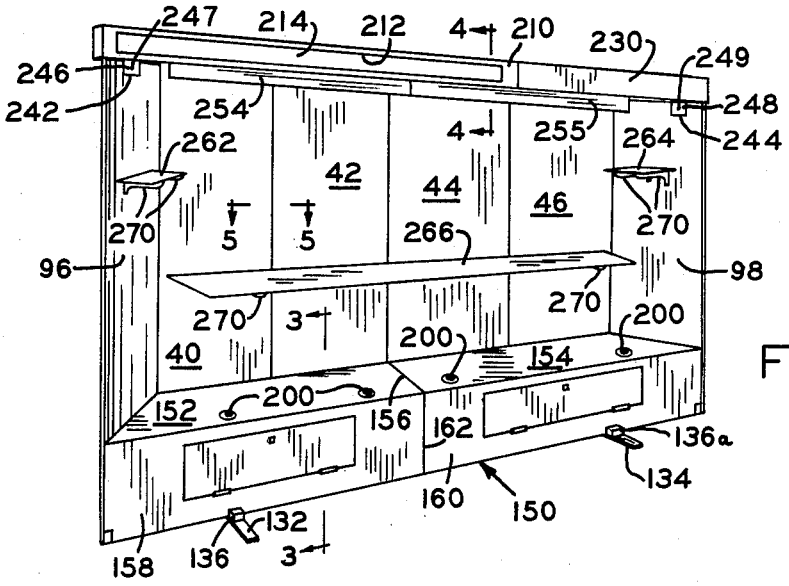
FIG. 1 is a view in perspective of an assembled display booth of this invention.
Figure 11:
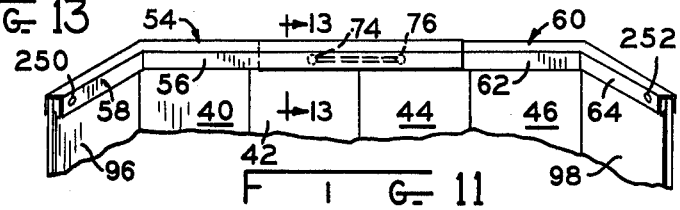
FIG. 11 is a partial view in perspective of the upper channel supports inserted over the top wall section edges.
Figure 12:
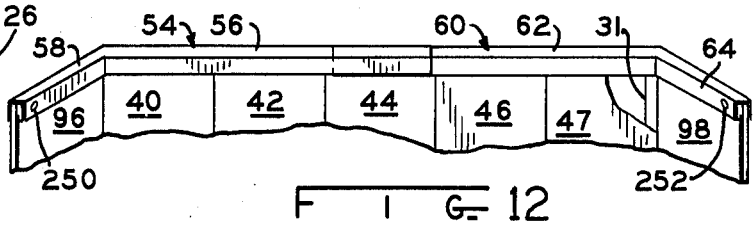
FIG. 12 is a view similar to FIG. 11 showing the channels in extended form and having an additional wall section inserted therein.
Figure 8:
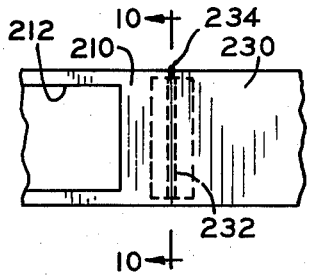
FIG. 8 is a partial view taken from the direction of arrow 8 of the light housing in FIG. 4.
Figure 9:
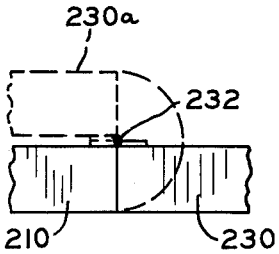
FIG. 9 is a top plan view of the light housing of FIGS. 4 and 8 shown in a folded position with the folded position shown in dashed lines.
Figure 10:
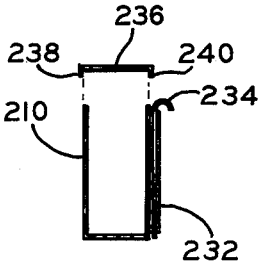
FIG. 10 is a section taken at 10—10 of FIG. 8.
Figure 14:
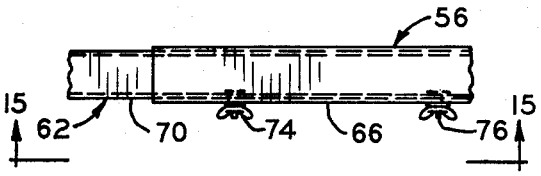
FIG. 14 is a top plan view of a partial channel construction wherein the channel sections are shown in telescoped position.
Figure 15:
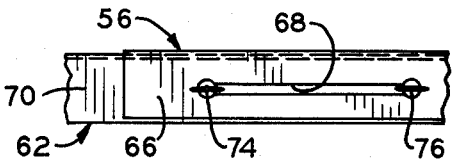
FIG. 15 is an elevational view taken from the indicated direction arrow 15 of the telescoped channels in FIG. 14.
Figure 17:
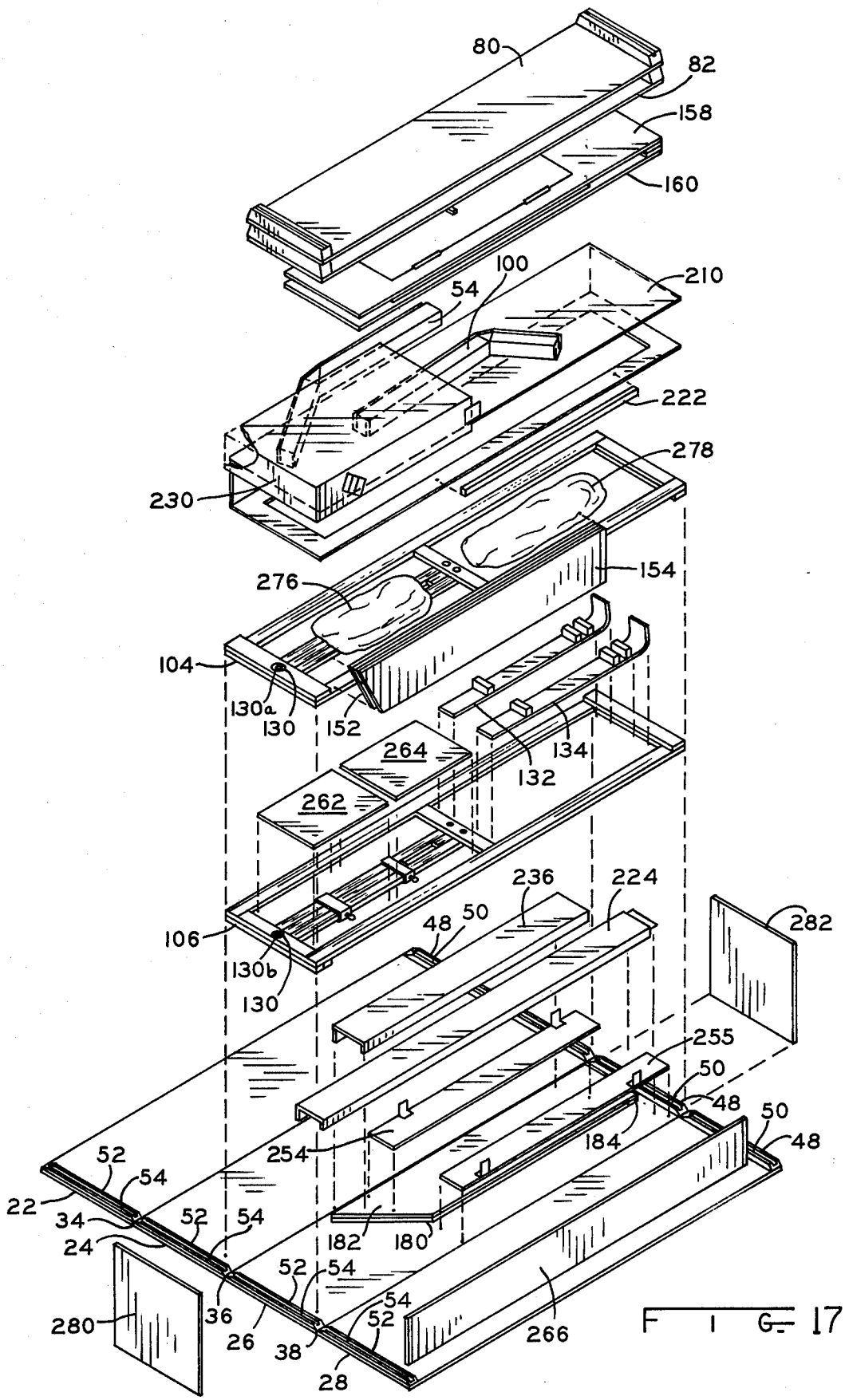
FIG. 17 is an exploded view of the display booth of FIG. 1 just prior to packing and forming of the shipping crate.

A second elongate housing channel 230 having a U-shaped cross-section is hinged to housing channel 210 by hinge 232, FIGS. 8–10, and has a removable hinge pin 234, FIG. 10, which when removed permits separation of channels 210 and 230 for nesting one within the other, FIG. 17, for packing and portability. Channel 230 may be pivoted to position **230*a* about hinge 232, FIG. 9. An elongate cover 236 has downturned longitudinal edges 238, 240 which are fittable over housing panel 230 to complete the housing enclosure. Plates 242 and 244, FIGS. 1 and 2, are affixed, as by welding, to the bottoms of housing channels 210 and 230, respectively. Channel housings 210 and 230 are supported at their respective outer ends on end channels 58 and 65, respectively. Plates 242 and 244 are obliquely aligned to correspond to the obliqueness of channels 58 and 64 and register with the front walls of channels 58 and 64, respectively. Holes 250, 252, FIG. 11, are formed respectively in the front walls of channels 58 and 64 and are registrable with holes 242 and 244, respectively, in plates 246 and 248. A suitable removable fastener, such as a wood screw is then rotatably driven through the aligned openings 246, 250 and openings 248 and 252 to securely and releasably hold housing channels 210, 230** in assembled relation.

Figure 4:
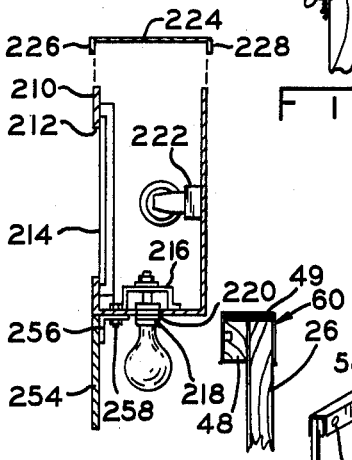
FIG. 4 is an enlarged section taken at 4—4 of FIG. 1.

An elongate light baffle having sections 254, 255, FIGS. 2 and 4, has a plurality of angle brackets 265 welded at longitudinally spaced points thereto. Brackets 256 are provided with openings in their inwardly extending legs which register with corresponding openings in the bottom of housing channels 210, 230 to receive threaded bolts 258, to removably secure baffle sections 254, 255 to the underside of housing channels 210, 230. Baffle sections 254, 255 direct the light from lighting fixtures 218 toward decorative panels 40, 42, 44 and 46 and to the display area in the booth.

Shelves 262, 264, 266, which may be made of acrylic plastic, FIG. 1, display booth walls, as the brackets 270 of conventional design which are removably attachable to the display booth walls. Additional shelving may be provided as desired.

In disassembly, packing and crating of the display booth, screws 247 and 249 are removed and channel housings 210, 230 are lifted from the upper edges of the display booth. Bolts 258 are loosened and light baffles 254, 255 are removed. Light fixtures 216 and 222 are removed from housing channels 210 and 230. Hinge pin 234 is removed separating housing channels 210 and 230 and housing tops 224 and 236 are removed from channels 210 and 230, respectively. Channel 230 is then nested in channel 210.

Nuts 200 are then removed from the threaded bosses 196 and cabinet tops 152,, 154 are lifted from brackets 190 and folded together one against the other. Pins 194 and brackets 190 are removed and cabinet fronts 158, 160 are removed and folded one against the other. Cabinet floor panels 180, 182 are lifted and folded together.

Top channels 54 and 60 are lifted from wall sections and wing nuts 74, 76 are removed. End sections 80 and 82 are lifted from bottom channels 100, 102. Bolts 130 are removed and arm bolts 124, 126 are loosened, permitting arm section 116c to be slipped upwardly between sections 116a and 116b to properly shorten the length of arms 116 which are then pivoted against their respect frames 104, 106 and bolt 130 is inserted through openings 130a and 130b, respectively, in frames 104, 106 and fastened to secure arms 160 into their respective frames for shipping. Frames 104 and 106 are removed from wall sections 22 and 28, respectively, and wall sections 22 to 28 are lifted from bottom panels 100, 102 which are disconnected and nested for shipping. Wall sections 22 to 28 are laid on the ground with strips 48 and 52 facing upwardly. The smaller components are placed in containers 276, 278 and the parts are stacked onto wall section 26, as shown in FIG. 17. Square end section 280 is inserted into groove 54 of strip 52 on wall section 26 and end section 282 is inserted in groove 50 of strip 48 for wall section 46. Each of strips 48 and 52 are beveled at their ends to permit inward folding of the wall sections about hinges 34, 36 and 38 with the grooves 52 fitting about the edges of end section 280 as the folding takes place and the grooves 50 fitting about the edges of end section 282. Once the folding has been completed, FIG. 18, wall section 22 may be secured to wall section 28 as by a hasp 284 in slotted strap 286 attached respectively to the edges of wall sections 28, 22 and a padlock 288 fastened about hasp 284. Thus, a versatile, expandible, display booth is completely packaged in a crate made from the display booth components plus end sections 280, 282.

While there have been described above the principles of this invention in connection with specific apparatus, it is to be clearly understood that this description is made only by way of example and not as a limitation to the scope of the invention.

What is claimed is:

1. A collapsible booth comprising:

a plurality of transversely alignable elongate wall sections and having longitudinal edges of adjacent sections in abutting relation; a hinge member being connected between each of the abutting longitudinal edges;

each of said wall sections having upper and lower transverse edges; the respective upper transverse edges being in horizontal alignment and the respective lower transverse edges being in horizontal alignment;

an elongate channel having a U-shaped cross-section removably fitted over at least one of the upper and lower transverse edges of the wall section for supporting said wall sections in a predetermined transverse alignment;

at least one elongate stabilizer being removably fitted to a lower transverse edge and extending substantially orthogonally therefrom;

a plurality of elongate supports removably attachable to said wall sections and orthogonally projecting a predetermined distance therefrom;

a planar elongate cabinet top layable over said supports in supported orthogonal relation to said wall sections;

an elongate planar cabinet front having vertically spaced upper and lower longitudinal edges, said front removably fitted to said stabilizer at a lower longitudinal edge of said front and to said top at the upper longitudinal edge of said front.

2. The apparatus of claim 1 including a plurality of panels dimensionally corresponding to said wall sections;

at least one of said wall sections having a bracket affixed along each longitudinal edge and protruding orthogonally therefrom; each of said brackets having an elongate lip formed thereon in orthogonally spaced relation to their respective wall sides to form an open retaining slot at each longitudinal edge, the retaining slots for each side being in facing relation to slidably receive and retain a panel.

3. The apparatus of claim 1 including an elongate groove being formed along each transverse edge of said wall sections; planar end covers having a plurality of side edges corresponding in number to the number of said wall sections; the dimensions of said side edges corresponding to the length of said grooves and insertable in said grooves as said wall sections are hingedly folded about said end covers to form an enclosed crate.

4. The apparatus of claim 1 including means for adjusting the length of said elongate channels whereby additional wall sides may be inserted in successive alignment with said plurality of wall sides to increase the transverse booth dimension.

5. The apparatus of claim 1 including elongate end panels having a length corresponding to said wall sections, a first end channel having a U-shaped cross-section attached to one end of said elongate channel to receive one of said end panels; a second end channel having a U-shaped cross-section attached to the other end of said elongate channel to receive another of said end panels.

6. The apparatus of claim 5 wherein said second and third channels are obliquely aligned with said first channel.

7. The apparatus of claim 1 including a supporting elongate frame affixed to the rear surface of at least one of said wall sides; an elongate support arm having one end pivotably connected to an intermediate longitudinal position of said frame; the other end of said arm removably attached to one of said stablizers.

8. The apparatus of claim 7 wherein said arms are longitudinally adjustable.

9. The apparatus of claim 1 including at least one door hingedly mounted to said front and swingable between open and closed positions to provide access to the space defined by said top, front, and wall sections.

10. The apparatus of claim 1 wherein said cabinet top has first and second elongate portions; a hinge connecting said first and second top portions whereby said portions may be folded against one another in one position and folded away from one another in an extended position.

11. The apparatus of claim 1 wherein said cabinet front has first and second elongate portions; a hinge connecting said first and second portions whereby said portions may be folded against one another in one position and folded away from one another in an extended position.

12. The apparatus of claim 1 including an elongate channel having a U-shaped cross-section removably fitted over each of said upper and lower longitudinal edges.

13. The apparatus of claim 2 wherein each of said wall sections have a bracket affixed along each longitudinal edge and protruding orthogonally therefrom.

* * * * *